US006189181B1

(12) United States Patent
Bissett

(10) Patent No.: US 6,189,181 B1
(45) Date of Patent: Feb. 20, 2001

(54) DOOR RETAINING DEVICE

(76) Inventor: Kevin J. Bissett, 1773 Milldrum St., Union Grove, WI (US) 53182

( * ) Notice: Under 35 U.S.C. 154(b), the term of this patent shall be extended for 0 days.

(21) Appl. No.: 09/301,387

(22) Filed: Apr. 24, 1999

(51) Int. Cl.[7] ..... E05F 1/08
(52) U.S. Cl. ..... 16/78; 16/79; 16/77; 16/83
(58) Field of Search ..... 16/78, 79, 75–77, 16/82; 49/404, 405, 138, 137

(56) References Cited

U.S. PATENT DOCUMENTS

| | | | | |
|---|---|---|---|---|
| 1,014,266 | * | 1/1912 | Stutler | 16/78 |
| 2,079,054 | * | 5/1937 | Vadasz | 16/78 |
| 2,295,496 | | 9/1942 | Cameron . | |
| 2,638,619 | | 5/1953 | Kearney . | |
| 3,045,276 | * | 7/1962 | Schwarz | 16/79 |
| 3,267,513 | * | 8/1966 | Wartian | 16/78 |
| 3,413,680 | * | 12/1968 | Rowe et al. | 16/78 |
| 3,502,280 | * | 3/1970 | Jessup et al. | 16/78 |
| 3,548,444 | * | 12/1970 | Jacobus et al. | 16/78 |
| 3,756,585 | * | 9/1973 | Mihalcheon | 16/78 |
| 3,937,487 | | 2/1976 | Pech . | |
| 4,001,972 | | 1/1977 | Hurwitz . | |
| 4,468,836 | | 9/1984 | Omata . | |
| 4,675,938 | * | 6/1987 | Bundschuh | 16/79 |
| 4,817,885 | | 4/1989 | Matsumoto . | |
| 5,630,249 | * | 5/1997 | Rebai et al. | 16/78 |
| 5,937,478 | * | 8/1999 | Regnier | 16/78 |

* cited by examiner

*Primary Examiner*—Chuck Y. Mah
(74) *Attorney, Agent, or Firm*—Jansson, Shupe, Bridge & Munger, Ltd.

(57) ABSTRACT

A door retaining structure is provided for limiting the path of a door pivotably mounted on a door frame. The door retaining structure includes a connection structure for interconnecting the door and the door frame. An inertial locking device is operatively connected to the connection structure for preventing movement of the door toward the open position in response to the predetermined force on the door.

18 Claims, 4 Drawing Sheets

FIG. 7
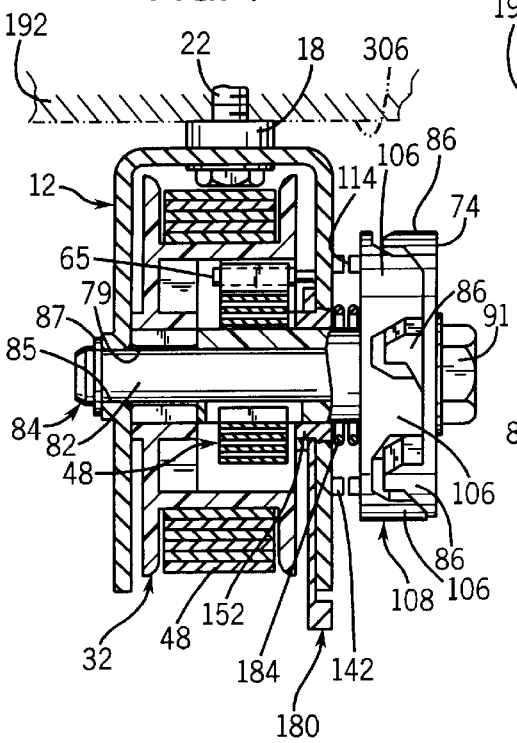
FIG. 8
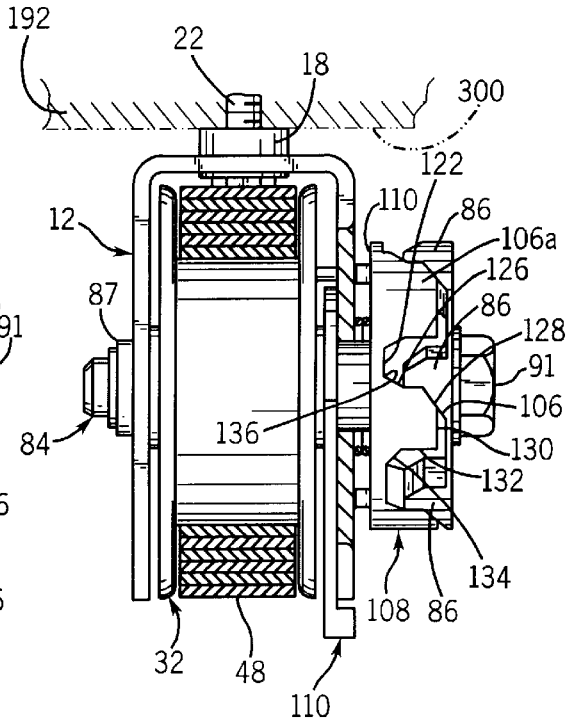
FIG. 9
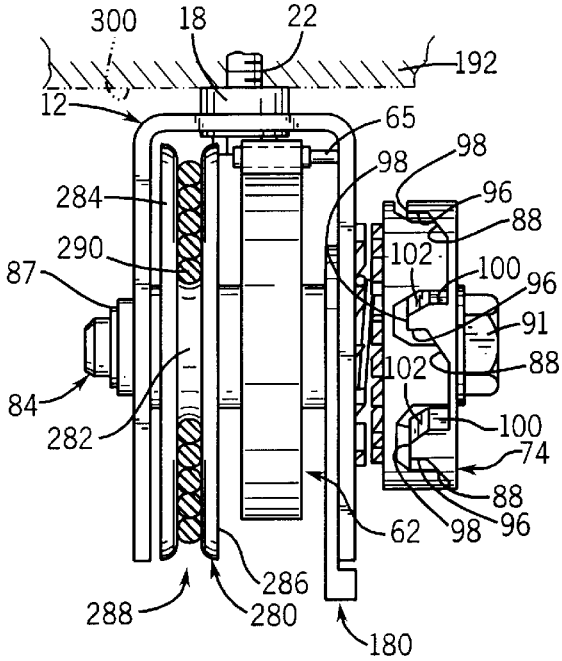
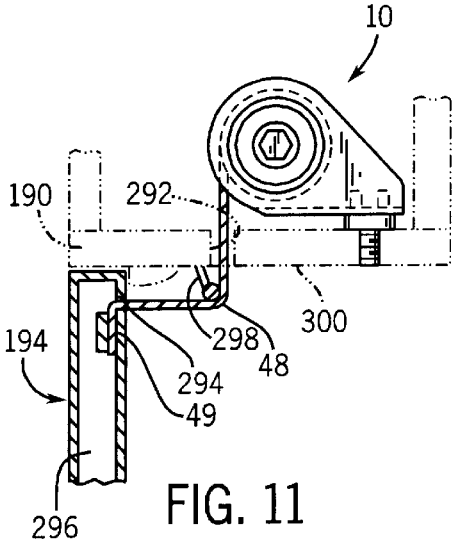
FIG. 11

X

DOOR RETAINING DEVICE

BACKGROUND OF THE INVENTION

This invention relates to doors, and in particular, to a device for preventing uncontrolled movement of a door toward the open position in response to a predetermined force thereon.

Most homes have front and rear doors to allow access to the interior of the structure. Storm and/or screen doors are mounted within the corresponding door frames to overlap the front and rear doors. Storm doors are designed to protect the outer surface of the front and rear doors of a home from the elements such as rain, snow or the like. On the other hand, screen doors are designed to allow a home owner to open the front and rear doors of the home in order for fresh air to enter the same, as well as, to prevent flying insects and the like from entering the home therethrough.

Since storm and screen doors have large surface areas and are lightweight, the storm and screen doors tend to open quickly when subjected to high winds or other types of violent opening forces. Consequently, due to the tendency for the storm and screen doors to swing open violently during strong gusts of wind, the storm and screen doors may be damaged, or in extreme cases, torn away from the door frames in which they are mounted.

Therefore, it is a primary object and feature of the present invention to provide a device for limiting the movement of a door in response to a predetermined force thereon.

It is a further object and feature of the present invention to provide a device for limiting movement of a door in response to a predetermined force thereon, which is easily mountable to a conventional storm and screen door.

It is a further object and feature of the present invention to provide a door restraining device for limiting movement of a door in response to a predetermined force thereon which is inexpensive to manufacture.

In accordance with the present invention, a door retaining device is provided. The door retaining device includes a connection structure for interconnecting the door and the door frame. An inertial locking structure is operatively connected the connection structure in order to prevent movement of the door toward the open position in response to a predetermined force on the door.

The connection structure includes a connector having first and second opposite ends. The first end of the connector is releaseably mounted to one of the door or the frame. A take-up mechanism is mounted to the other of the door or the frame and interconnected to the second end of the connector. The take-up mechanism urges the door toward the closed position. The connection structure also includes a quick release structure for releaseably interconnecting the first end of the connector to one of the door or the frame. The quick release structure has a manual release actuator moveable between the first non-release position and a second release position for disengaging the first end of the connector from the one of the door or the frame.

The door retaining device may also include an adjustment structure for varying the predetermined force necessary to prevent movement of the door toward the open position.

In accordance with a still further aspect of the present invention, a door path limiting device is provided for limiting the movement of a door pivotably mounted in a frame. The door path limiting device includes a cable having first and second opposite ends. The first end of the cable is releaseably mounted to one of the door or the frame. A take-up reel is mounted to the other of the door or the frame and is interconnected to the second end of the cable. The take-up reel is rotatable in a first winding direction for winding the cable thereon and a second unwinding direction. A retracting structure generates a rotational force on the take-up reel in the winding direction so as to wind the cable on the take-up reel. An inertial locking structure prevents rotation of the take-up wheel in the unwinding direction in response to a predetermined rotational force on the take-up reel in the unwinding direction.

The inertial locking structure may include a first cam operatively connected to the take-up reel for rotational movement therewith and having a cam surface. A rotational locking cam rotates with the first cam and has a first engagement surface slidable along the cam surface of the first cam between an unlocked and a locked position in response to a rotational force thereon. A locking element extends from the rotatable locking cam for preventing rotation of the first cam when the locking cam is in a locked position. A biasing structure biases the rotatable locking cam toward the unlocked position. It is contemplated that an adjustment structure be provided for adjusting the predetermined force necessary to prevent the rotation of the take-up reel.

A housing is mounted to one of the door or frame for rotatably supporting the take-up reel. The housing includes a plurality of teeth projecting therefrom. The locking element includes a plurality of teeth projecting from the rotatable locking cam. The teeth of the rotatable locking cam mesh with the teeth projecting from the housing when the rotatable locking cam is in the locked position.

The door path limiting device may also include a quick release structure for releaseably interconnecting the first end of the cable to the one of the door or frame. The quick release structure includes a manual release actuator moveable between a first non-release position and a second release position for disengaging the first end of the cable from the one of the door or frame.

In accordance with a still further aspect of the present invention, a door retaining structure is provided for limiting the path of a door pivotably mounted on a door frame. The door retaining structure includes a take-up mechanism operatively connected to the door frame. The take-up mechanism is rotatable in a first unwinding direction and a second winding direction. A biasing structure biases the take-up mechanism in the winding direction. A door connection element has a first end releaseably mounted to the door and a second end interconnected to the take-up mechanism wherein the door connection element winds onto the take-up mechanism in response to rotation of the take-up mechanism in the winding direction. An inertial locking structure prevents rotation of the take-up wheel in the unwinding direction in response to a predetermined rotational force on the take-up reel in the unwinding direction.

The inertial locking structure may include a rotatable locking cam rotatable with the take-up mechanism and moveable between an unlocked and a locked position in response to a predetermined rotatational force on a take-up mechanism. A locking element extends from the rotatable locking cam and prevents rotation of the take-up mechanism when the locking cam is in the locked position. The inertial locking structure also includes an adjustment structure for adjusting the predetermined force necessary to move the locking cam from the locked to the unlocked position. Biasing structure biases the rotatable locking cam toward the unlocking structure.

The door retaining structure also includes a housing mounted to the frame for rotatably supporting the take-up mechanism. The housing includes a plurality of teeth projecting from the rotatable locking cam. The teeth of the rotatable locking cam mesh with the teeth projecting from the housing when the rotatable locking cam is in the locked position. A quick release structure is provided for releaseably interconnecting the first end of the cable to the door.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 7 is a cross-sectional view of the door retaining device of the present invention taken along line 7—7;

FIG. 8 is a side elevational view, partially in section, showing the door retaining device of the present invention;

FIG. 9 is a side elevational view, similar to FIG. 8, showing an alternate embodiment of the door retaining device of the present invention;

FIG. 11 is a side elevational view, partially in section, showing an alternate mounting arrangement for the door retaining device of the present invention.

DETAILED DESCRIPTION OF THE PREFERRED EMBODIMENT

Figures 10, 12:
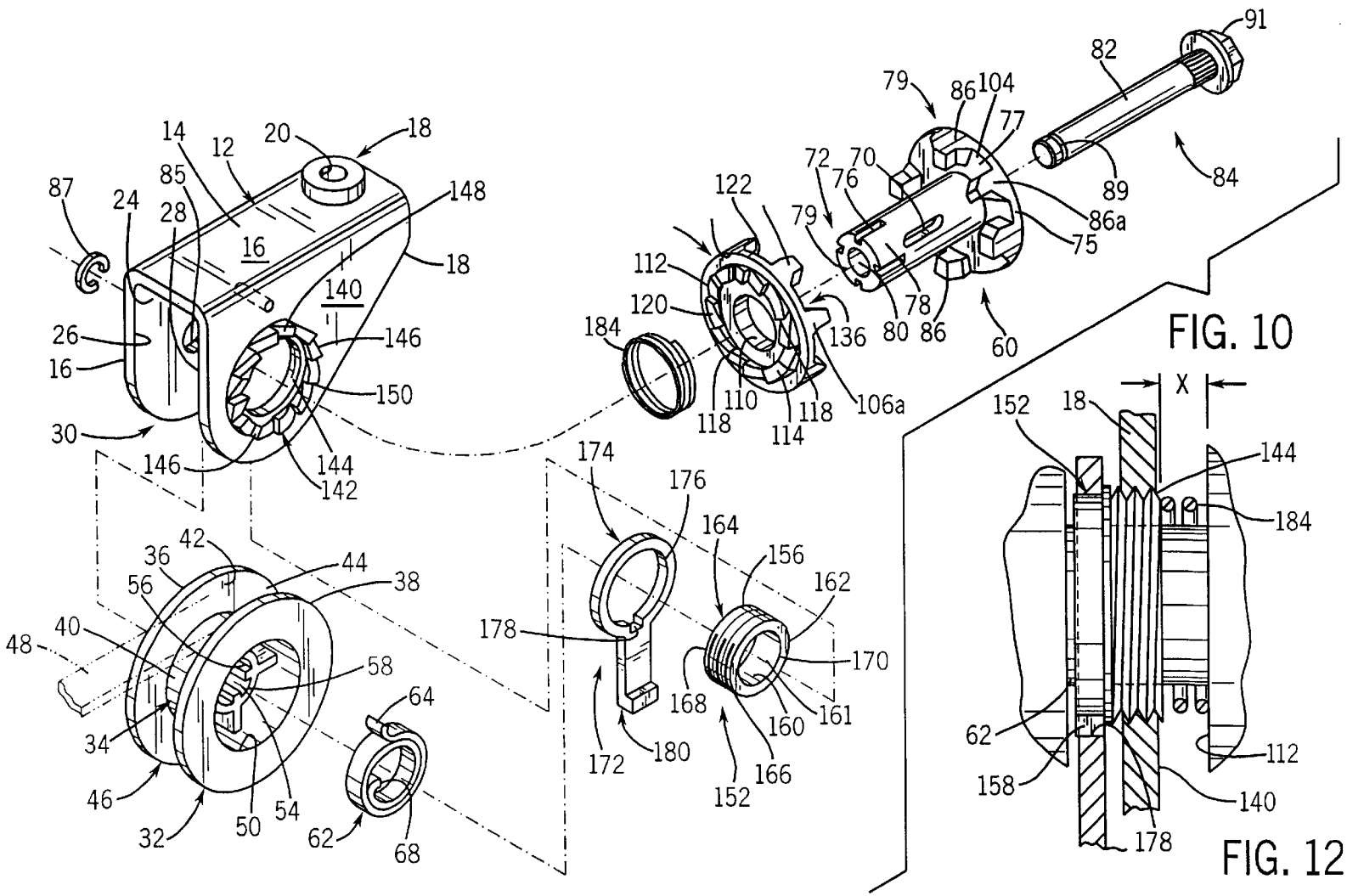
FIG. 10 is an exploded, isometric view of the door retaining device of the present invention.
FIG. 12 is an enlraged, cross-sectional view showing a portion of the door retaining device of the present invention.

Referring to FIG. 10, a door retaining device in accordance with the present invention is generally designated by the reference numeral 10. The door retaining device 10 includes a generally U-shaped housing 12 having a generally flat base plate 14 with first and second spaced sidewalls 16 and 18, respectively, projecting therefrom. The outer surface 16 of base plate 14 includes a disc-shaped spacer element 18 projecting therefrom. Disc-shaped spacer element 18 includes a passageway 20 therethrough which is aligned with and in communication with an aperature (not shown) in base plate 14 for accommodating a fastening bolt, 22, FIGS. 7–9, therethrough, for reasons hereinafter described.

Inner surface 24 of base plate 14 and inner surfaces 26 and 28 of sidewall 16 and 18, respectively, of housing 12 define a spool receiving cavity 30 therebetween. Spool receipt cavity 30, as defined by housing 12, is adapted for receiving a spool 32 therein. In a first embodiment, FIGS. 7–8 and 10, spool 32 includes a generally cylindrical body portion 34 having heads 36 and 38, respectively, on opposite ends thereof. The outer cylindrical surface 40 of cylindrical portion 34 and the inner surfaces 42 and 44 of heads 36 and 38, respectively, define a strap receiving cavity 46. A strap 48 is mounted on cylinder portion 34 of spool 32. Strap 48 includes a first end (not picture) connected to cylindrical portion 34 and a second opposite end having a conventional seat belt buckle 49, FIG. 5, connected thereto. Spool 32 further includes a recoil spring receipt cavity 50 extending into the outer surface 52 of head 38. Recoil spring receipt cavity 50 communicates with a spindle receipt passageway 54 which extends along the longitudinal axis of cylindrical body portion 34 of spool 32. Spindle receipt passageway 54 is defined by generally cylindrical inner surface 56 of cylindrical body portion 34 of spool 32. Inner surface 56 of cylindrical body portion 34 includes a plurality of circumferentially spaced splines 58 extending therealong which are received within corresponding circumferentially spaced grooves 76 in spindle 60, as hereinafter described.

A recoil spring 62 is positioned within recoil spring receipt seat cavity 50 in spool 32. Recoil spring 62 includes a first outer end 64 interconnected to pin 65, FIG. 7, extending from inner surface 28 of sidewall 18 of housing 12 into spool receiving cavity 30 so as to rigidly maintain recoil spring 62 in a fixed relationship with housing 12. A second end 68 of recoil spring 62 is received within slot 70 in spindle 60 so as to urge spindle 60 toward a first, fully wound portion.

Spindle 60 is generally cylindrical in shape and extends a longitudinal axis which is coincident with the longitudinal axis of spool 32. Spindle 60 includes a first end 72 and an enlarged, opposite second end 74. First end 60 of spindle 74 includes a plurality of circumferentially spaced grooves 76 extending along the outer surface 78 of spindle 60 in a direction generally parallel to the longitudinal axis of spindle 60. Grooves 76 are adapted for receiving corresponding splines 58 extending along inner surface 56 of spool 32 in a mating relationship such that spindle 60 and spool 32 rotates in unison about the longitudinal axis of spindle 60.

Spindle 60 further includes a generally cylindrical, rotational bearing surface 79 which defines a passageway 80 between the first and second ends 72 and 74, respectively, of spindle 60. Passageway 80 through spindle 60 has a diameter approximating the diameter of shaft 82 of bolt 84. Bolt 84 extends through passageway 80 in spindle 60 and through opening 85 in sidewall 16 of housing 12. A locking washer 87 is positioned within a circumferentially extending groove 89 in shaft 82 of bolt 84 so as to retain bolt 84 in position 12 and to capture spindle 60 on bolt 84 between locking washer 87 and bolt head 89. As described, bearing surface 79 of spindle 60 forms a rotational interface with the outer surface of shaft 82 of bolt 84.

Second end 74 of spindle 60 includes a plurality of ears 86 which are circumferentially spaced about the longitudinal axis of spindle 60 and which project from inwardly directed surfaces 77 in a direction parallel to the longitudinal axis. Referring to FIGS. 7–10, each ear 86 includes a first angled surface 88 which extends from the inwardly directed surface 90 of second end 74 of spindle 60 at a predetermined angle to the longitudinal axis of spindle 60. Each ear 86 further includes a longitudinally extending guide surface 96 which extends from a corresponding angled surface 88 and terminates at a generally planar end surface 98 perpendicular thereto.

Each ear 86 is further defined by a second longitudinally extending guide surface 100 which extends from the inner surface 90 of second end 74 of spindle 60. Each second guide surface 100 is interconnected to its corresponding end surface 98 by a second angled surface 102. As best seen in FIG. 10, surfaces 88 and 96 of ear 86 and surfaces 100 and 102 of an adjacent ear 86*a* define a flywheel ear receipt cavity 104, FIG. 10, therebetween which is dimensioned for receiving a corresponding flywheel ear 106 projecting from flywheel 108, as hereinafter described.

Flywheel 108 is generally ring-shaped and includes a generally circular opening 110 therethrough dimensioned such that flywheel 108 may be positioned about spindle 60. Flywheel 108 is defined by inwardly directed surface 112 having a plurality of teeth 114 which are circumferentially spaced about opening 110. Each tooth 114 includes a stopping surface 116 which extends from the inwardly directed surface 112 of flywheel 108 in a direction parallel to the longitudinal axis of spindle 60. Stopping surface 116 terminates at an outer edge 118. A ramped surface 120 extends between from the inwardly directed surface 112 of flywheel 108 and outer edge 118 of stopping surface 116.

Flywheel 108 further includes an outwardly directed surface 122. As best seen in FIG. 8, ears 106 extend from outwardly directed surface 122 of flywheel 108 towards second end 74 of spindle 60 in a direction parallel to the longitudinal axis of spindle 60. Each ear 106 of flywheel 108 is defined by a first ear engaging surface 126 extending from outwardly directed surface 122 thereof. An angled guide surface 128 interconnects ear engaging surface 126 with end surface 130 of ear 106. Each ear 106 of flywheel 108 is further defined by a second ear engaging surface 132 which extends from end surface 130 towards outwardly directed surface 122 of flywheel 108 in a direction generally parallel to the longitudinal axis of spindle 60. A ramped surface 134 interconnects each outwardly facing surface 122 to its corresponding second ear engaging surface 132 of flywheel 108.

First ear engaging surface 122 and guide surface 128 of ear 106 along with second ear engaging surface 132 and ramped surface 134 of an adjacent ear 106*a* define a spindle ear receipt cavity 136 therebetween, FIG. 10. Spindle ear receipt cavity 136 of flywheel 108 is adapted to receive a corresponding ear 86 projecting from second end 74 of spindle 60 therein.

Inwardly directed surface 112 of flywheel 108 faces the outer surface 140 of sidewall 18 of housing 12 such that teeth 114 of flywheel 108 are axially aligned with corresponding teeth 142 projecting from outer surface 140 of sidewall 18. As best seen in FIG. 10, teeth 142 of housing 12 are circumferentially spaced about a threaded opening 144 in sidewall 18. Opening 144 in sidewall 18 of housing 12 has a center which lies on the longitudinal axis of spindle 60. Each tooth 142 of sidewall 18 of housing 12 includes a stop surface 146 projecting outwardly from outer surface 140 of sidewall 18 of housing 12 in a direction parallel to longitudinal axis of spindle 60. An angled surface 148 extends between outer surface 140 of sidewall 18 and terminal edge 150 of stop surface 146. As best seen in FIG. 8, it is contemplated that teeth 114 of flywheel 108 and teeth 142 of housing 12 may mesh such that stopping surfaces 116 of teeth 114 of flywheel 108 engage and abut corresponding stopping surfaces 146 on teeth 142 of housing 12.

Referring to FIGS. 10 and 12, a spring tension adjustment sleeve 152 is positioned about spindle 60, at a location adjacent recoil spring 62. Spring tension adjustment sleeve 152 is defined by a generally cylindrical outer surface 156 having a projection 158 extending radially therefrom. Spring tension adjustment sleeve 152 further includes a generally cylindrical inner surface 160 defining a passageway 161 between the first and second ends 162 and 164 thereof. Passageway 161 within spring tension adjustment sleeve 152 is dimensioned so as to allow spindle 60 to pass therethrough. The outer surface 156 of spring tension adjustment mechanism 152 includes threads 166 adjacent the first end 162 thereof. Threads 166 are adapted for receipt in threaded opening 144 in sidewall 18 of housing 12.

Spring tension adjustment sleeve 152 further includes a first end surface 168 directed towards recoil spring 162 and a second end surface 170 directed towards flywheel 108. A spring adjustment handle 172 is provided for threading spring tension adjustment mechanism 152 into and out of threaded opening 144 and sidewall 18 of housing 12. Handle 172 includes a body portion 174 having an opening 176 therein. Opening 176 in body portion 174 is generally circular in shape and includes a projection receiving depression 178 therein. Body portion 174 is positioned about the outer surface 156 of spring tension adjustment sleeve 152 such that projection 158 extending from the outer surface 156 of spring tension adjustment sleeve 152 is seated within spring receipt depression 178 in order for handle 172 and spring tension adjustment mechanism 152 to rotate in unison about the longitudinal axis of spindle 60. Gripping portion 180 extends from body portion 174 of handle 172 and allows a user to thread spring tension adjustment mechanism into and out of threaded opening 144 in sidewall 18 of housing 12 by simply rotating handle 172 about the longitudinal axis of spindle 60.

A coil spring 184 is positioned between the second end surface 170 of spring tension adjustment sleeve 152 and inwardly directed surface 112 of flywheel 108 so as to bias flywheel 108 away from the outer surface 140 of sidewall 18 of housing 12, from left to right in FIGS. 7–8. The biasing force on flywheel 108 may be adjusted by threading spring tension adjustment member 152 into and out of threaded opening 144 in sidewall 18 of housing 12. By way of example, by reducing the axial distance X between end surface 170 of spring tension adjustment sleeve 152 and the inwardly directed surface 112 of flywheel 108, the biasing force generated by coil spring 184 will increase. As is known, the biasing force generated by coil spring 184 will increase as the axial distance X between end surface 170 of spring tension adjustment sleeve 152 and inwardly directed surfaces 112 of flywheel 108 is reduced.

Figure 2:
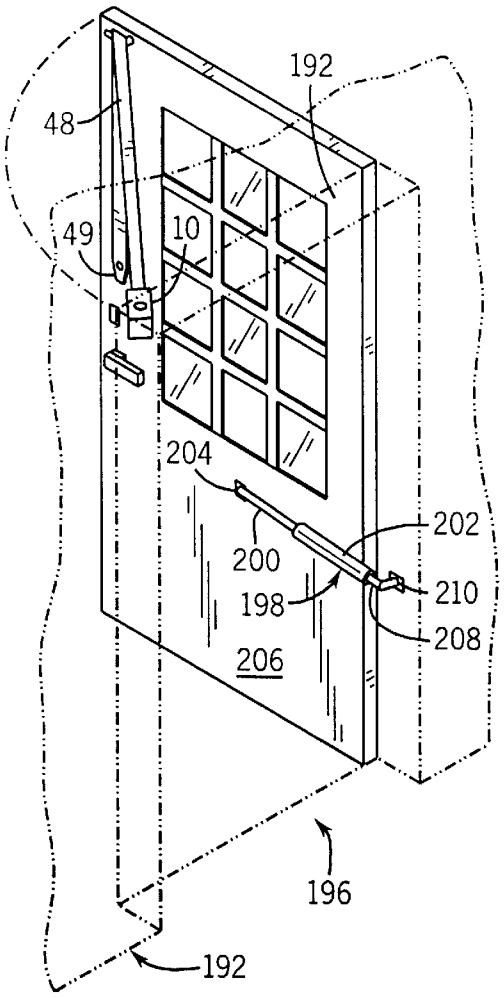
FIG. 2 is an isometric view of the door retaining device of the present invention interconnecting the door jam and the door depicting the door in an open position.
Figure 4:
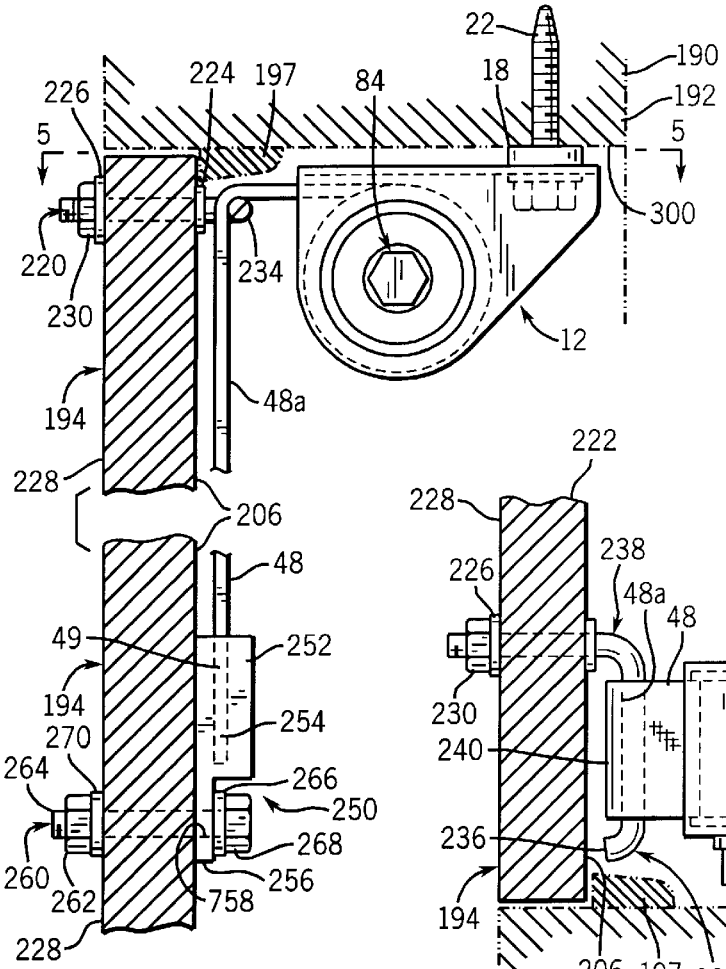
FIG. 4 is a cross-sectional view of FIG. 1 taken along line 4—4.
Figure 5:
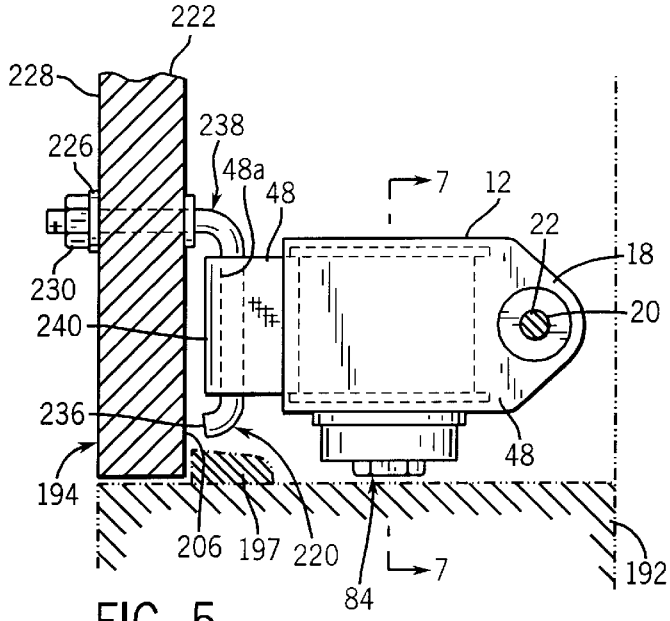
FIG. 5 is a cross-sectional view of the door retaining device of the present invention taken along line 5—5 of FIG. 4.
Figure 6:
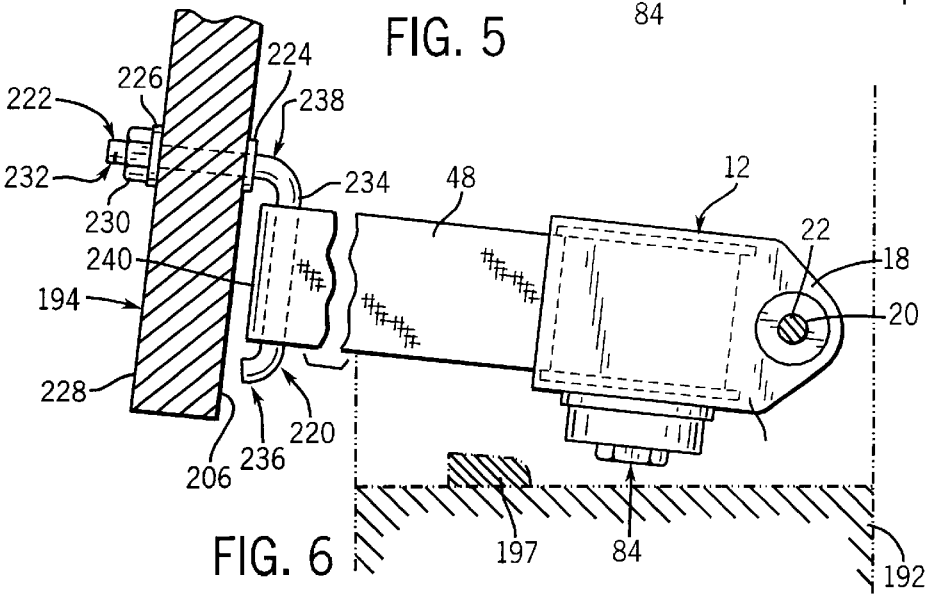
FIG. 6 is a top plan view, partially in section, showing the door retaining device of the present invention with the door in a partially opened position.

Referring to FIGS. 4–6, in order to interconnect housing 12 to a conventional door jam 192, fastening bolt 22 is inserted through the aperture (not shown) in base plate 14 of housing 12, through spacer element 18, and into the upper cross tie or header 190 of door jam 192 such that housing 12 is pivotable about the longitudinal axis of fastening bolt 22, FIGS. 5–6. As is conventional, a screen door 194 is interconnected to doorjam 192 by a plurality of hinges (not shown) such that screen door 194 is pivotable between a first closed position, FIG. 1, wherein screen door 194 is seated within opening 196 defined by door jam 192 and a second opened position, FIG. 2, wherein screen door 194 is removed from opening 196 so as to allow for the ingress and egress of individuals through opening 196. A stop 197 may affixed to the door jam 192 to prevent screen door 174 from pivoting beyond the closed portion.

It is contemplated that a pneumatic cylinder 198 connect screen door 194 to door jam 192. Pneumatic cylinder 198 includes a shaft 200 received within a cylinder 202. Shaft 200 has a terminal end 204 pivotably mounted to the inner surface 206 of screen door 194. End 208 of sleeve 202 is pivotably connected to jam 192 by a connection element 210, as is conventional. Pneumatic cylinder 198 limits the travel of screen door 194 and draws screen door 194 towards the closed position, FIG. 2, as is conventional.

Referring to FIGS. 4–6, a generally L-shaped strap guide bracket 220 is interconnected to screen door 194. The guide bracket 220 includes a first leg 222 having an enlarged stop 224 projecting radially therefrom. First leg 222 of guide bracket 220 extends through screen door 194 such that stop 224 engages and abuts the inner surface of screen door 194. A washer 226 is positioned on the first leg 222 of guide bracket 220 so as to abut the outer surface 228 of screen door 194. A nut 230 is threaded onto a threaded end 232 of first leg 222 of guide bracket 220 so as to interconnect guide bracket 220 to screen door 194 and to capture screen door 194 between washer 226 and stop 224.

Second leg 234 of guide bracket 220 is generally perpendicular to first leg 234. Second leg 234 of guide bracket 220 includes a curved, terminal end 236 which terminates at a predetermined distance from the inner surface 206 of screen door 194 greater than the thickness of strap 48 so as to allow strap 48 to pass therebetween. The intersection 238 of first and second legs 222 and 234, respectively, of guide bracket 220 and terminal end 236 of second leg 234 define a strap guiding portion 240 therebetween.

A quick release mechanism generally designated by the reference numeral 250 is also interconnected to the inner surface 206 of screen door 194. It is contemplated that quick release mechanism 250 take the form of a standard locking clip 252 for receiving the buckle 49 of a seat belt in a conventional manner. Locking clip 252 is positioned adjacent to inner surface 206 of screen door 194 and includes a mounting portion 256 depending therefrom. A bolt 260 extends through an aperture 258 in mounting portion 256 of release mechanism 250 and through screen door 194. A nut 262 is threaded onto the threaded end 264 of bolt 260 in order to maintain release mechanism 250 on screen door 194. It is contemplated to provide a washer 266 between head 268 of bolt 260 and mounting portion 256 of release mechanism 250. Similarly, a washer 270 may be provided between nut 262 and the outer surface 228 of screen door 194.

In operation, strap 48 is drawn from spool 32 against the bias of recoil spring 62. If released, strap 48 will be recoiled on spool 32 since recoil spring 62 will urge spindle 60, and hence spool 32, to the wound position heretofore described. Strap 48 is positioned over guide bracket 220 such that the inner surface 48*a* of strap 48 engages the second leg 234 of connection bracket 220 within strap guiding portion 240 of guide bracket 220. Terminal end 236 of second leg 234 of guide bracket 220 and intersection 238 of first and second legs 224 and 234, respectively, of guide bracket 220 guide strap 48 as strap 48 travels through strap guiding portion 240. Buckle 49 of strap 48 is inserted into buckle receipt cavity 254 in locking clip 252 in a conventional manner such that locking clip 252 retains buckle 49 therein.

As strap 48 is uncoiled from spool 32, the biasing force of spring 184 urges flywheel 108 towards second end 74 of spindle 60 such that the terminal face 130 of each ear 106 of flywheel 108 engages inwardly directed surface 77 of second end 74 of spindle 60. If strap 48 is uncoiled from spool 32 above a predetermined rotational velocity, the centrifugal force acting on flywheel 108 will urge flywheel 108 against the bias of coil spring 184 which, in turn, causes flywheel 108 to be urged from right to left in FIGS. 7 and 8.

As flywheel 108 is urged from right to left of FIGS. 7 and 8, teeth 114 projecting from the inwardly directed surface 112 of flywheel 108 engage and mesh with teeth 142 projecting from the outer surface 140 of sidewall 18 of housing 12. Stopping surfaces 116 of teeth 114 extending from flywheel 108 engage corresponding stop surfaces 146 of teeth 142 extending from housing 12 so as to prevent further rotation of flywheel 108 about the longitudinal axis of spindle 60.

As flywheel 108 is urged from right to left in FIGS. 7 and 8, angled surfaces 88 of ears 86 slide along corresponding guide surfaces 128 of ears 106 such that guide surfaces 98 of ears 86 engage corresponding ear engaging surface 126 of ears 106. With flywheel 108 fixed with respect to housing 12 and ears 86 of spindle 60 engaging ears 106 of flywheel 108, spindle 60, and hence, spool 32, is prevented from further rotation about the longitudinal axis of spindle 60. As a result, strap 48 cannot be uncoiled from spool 32.

The rotational velocity at which point the further unwinding of strap 48 from spool 32 is prevented may be adjusted by threading spring tension adjustment sleeve 152 into and out of threaded opening 144 in sidewall 18 of housing 12. By decreasing the axial distance X between end surface 170 of spring tension adjustment sleeve 152 and the inwardly directed surface 112 of flywheel 108, the biasing force of spring 184 increases. As a result, a greater centrifugal force must be generated on flywheel 108 in order for flywheel 108 will move from right to left in FIGS. 7 and 8. Consequently, the rotational velocity for unwinding the strap 48 from spool 32 will necessarily be greater than at the initial setting of spring tension adjustment sleeve 152. It can be appreciated that the user may reduce the rotational velocity necessary to prevent further unwinding of strap 45 from spool 32 by simply increasing the axial distance between end surface 170 of spring tension adjustment sleeve 152 and the inwardly directed surface 112 of flywheel 108.

Figure 3:
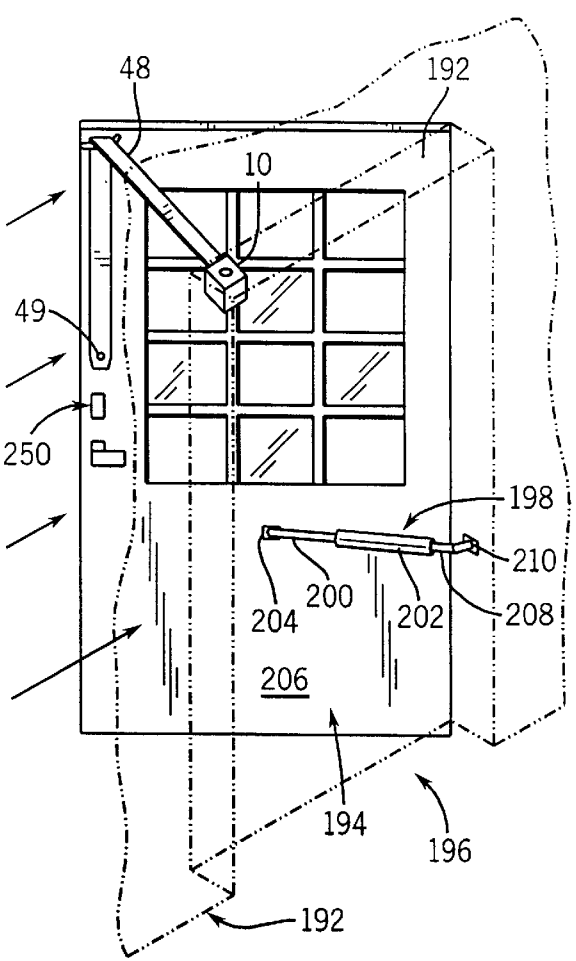
FIG. 3 is an isometric view of the door retaining device of the present invention interconnecting the door jam and the door depicting the door in an intermediate, partially opened position.
Figure 1:
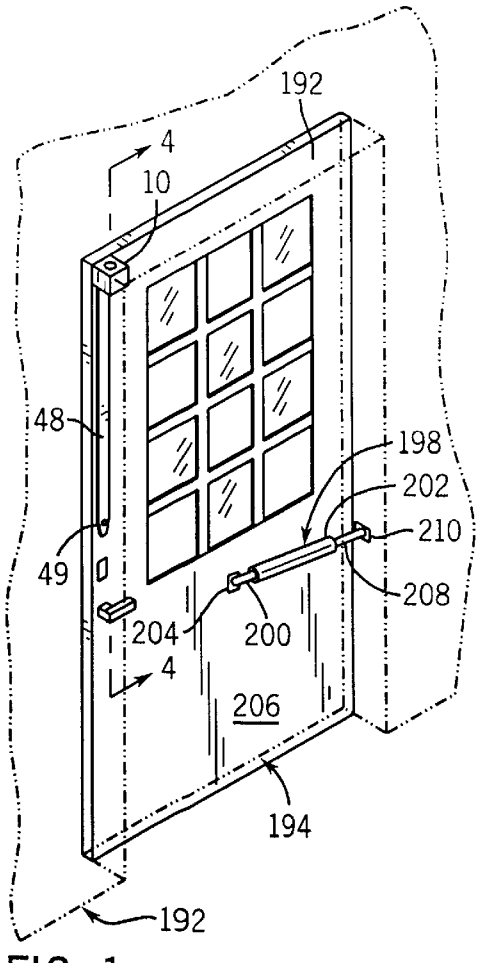
FIG. 1 is an isometric view of a door retaining device in accordance with the present invention interconnecting a door jam and a door depicted in a closed position.

Referring to FIG. 1, screen door 194 is in the closed position with buckle 49 of strap 48 received within corresponding locking clip 252. As screen door 194 is opened, FIG. 2, housing 12 pivots on fastening bolts, FIG. 6, in order to prevent binding of strap 48 as it is wound onto and unwound off of spool 32. If strap 48 is unwound from spool 32 above a predetermined rotational velocity, as heretofore described, teeth 114 of flywheel 108 will engage corresponding teeth 142 of housing 12 and the unwinding of strap 32 will cease as heretofore described. As a result, strap 48, interconnected to screen door 194, will prevent the further opening of screen door 194, FIG. 3.

Referring to FIG. 9, an alternate spool 280 is provided for use in connection with door having heads 284 and 286 on opposite sides thereof. A cord receiving cavity 288 is defined between heads 284 and 286 of spool 280 for receiving cord 290 therein. Cord 290 has a first end retained to the body portion 282 of spool 280 and a second end which is releasably interconnected to screen door 194. The remaining components of the door retaining device 10 disclosed in FIG. 9 are substantially identical to heretofore described with respect to FIG. 10, and as such, the description of the door retaining device 10 with respect to FIG. 10 is understood to describe the structure and operation of the door retaining device shown in FIG. 9.

FIG. 11 discloses an alternate mounting arrangement for the door retaining device of the present invention. As best seen in FIG. 11, door retaining device 10 is mounted above header 190 of door jam 192. Header 90 includes an opening 292 therein so as to allow strap 48 to pass therethrough. Screen door 194 includes an opening 294 therein to allow for buckle 49 to be inserted through opening 294 into the interior 296 of screen door 194. Buckle 49 is affixed within the interior 296 of screen door 194 in any known matter. It is contemplated that a guide bracket 298 depend from the lower surface 300 of header 190 of door jam 192 so as to guide the travel of strap 48 during the opening and closing of screen door 192, in a manner heretofore described.

Various modes of carrying out the invention are contemplated as being within the scope of the following claims particularly pointing out and distinctly claiming the subject matter which is regarded as the invention.

I claim:

1. A door retaining device for a door, the door pivotably mounted in a door frame and movable between an open and a closed position, comprising:

a connection structure for interconnecting the door and the door frame, the connection structure including:

a connector having first and second opposite ends, the first end of the connector releasablv mounted to one of the door or the frame; and a take-up mechanism mounted to the other of the door or the frame and interconnected to the second end of the connector, the take-up mechanism exerting a closing force on the connector so as to urge the door toward the closed position; and an inertial locking structure operatively connected to the connection structure, the inertial locking structure being movable in response to a predetermined force on the door urging the door towards the open position between a non-locking position and second locking position wherein movement of the door towards the open position is prevented.

2. The device of claim 1 wherein the connection structure includes a release structure for releaseably interconnecting the first end of the connector to the door.

3. The device of claim 2 wherein the release structure includes a manual release actuator movable between a first non-release position and a second release position for disengaging the first end of the connector from the door.

4. The device of claim 1 wherein the inertial locking structure further includes an adjustment structure for varying the predetermined force necessary to move the inertial locking structure to the locking position.

5. A door path limiting device for limiting the movement of a door pivotably mounted in a frame, comprising:

a cable having first and second opposite ends, the first end of the cable releaseably mounted to one of the door or the frame;

a take-up reel mounted to the other of the door or the frame and interconnected to the second end of the cable, the take-up reel rotatable in a first winding direction for winding the cable thereon and a second unwinding direction;

a retracting structure for generating a rotational force on the take-up reel in the winding direction to wind the cable on the take-up reel; and an inertial locking structure operatively connected to the take-up reel and being movable in response to a predetermined rotational force on the take-up reel in the unwinding direction between a first non-locking position wherein the take-up reel is free to rotate in the unwinding direction and a second locking position wherein the take-up reel is prevented from rotating in the unwinding direction.

6. The device of claim 5 further comprising a release structure for releaseably interconnecting the first end of the cable to the door.

7. The device of claim 6 wherein the quick release structure includes a manual release actuator movable between a first non-release position and a second release position for disengaging the first end of the cable from the door.

8. A door retaining structure for limiting the path of a door pivotably mounted on door frame, comprising:

a take-up mechanism operatively connected to the door frame, the take-up mechanism rotatable in a first unwinding direction and a second winding direction;

biasing structure for biasing the take-up mechanism in the winding direction;

a door connection element having a first end releaseably mounted to the door and a second end interconnected to the take-up mechanism wherein the door connection element winds onto the take-up mechanism in response to rotation of the take-up mechanism in the winding direction;

a rotatable locking cam rotatable with the take-up mechanism and movable between an unlocked and a locked position in response to the predetermined rotational force on the take-up mechanism; and a locking element extending from the rotatable locking cam for preventing rotation of the take-up mechanism when the locking cam is in the locked position.

9. The device of claim 8 further comprising an adjustment structure for adjusting the predetermined force necessary to move the locking cam from the unlocked to the locked position.

10. The device of claim 9 further comprising a locking cam biasing structure for biasing the rotatable locking cam toward the unlocked position.

11. The device of claim 10 further comprising a housing mounted to the frame for rotationally supporting the take-up mechanism, the housing including a plurality of teeth projecting therefrom.

12. The device of claim 11 wherein the locking element includes a plurality of teeth projecting from the rotatable locking cam, the teeth of the rotatable locking cam meshing with the teeth projecting from the housing when the rotatable locking cam is in the locked position.

13. The device of claim 8 further comprising a release structure for releaseably interconnecting the first end of the cable to the door.

14. A door path limiting device for limiting the movement of a door pivotably mounted in a frame, comprising:

a cable having first and second opposite ends, the first end of the cable releaseably mounted to one of the door or the frame;

a take-up reel mounted to the other of the door or the frame and interconnected to the second end of the cable, the take-up reel rotatable in a first winding direction for winding the cable thereon and a second unwinding direction;

a retracting structure for generating a rotational force on the take-up reel in the winding direction to wind the cable on the take-up reel; and an inertial locking structure for preventing rotation of the take-up reel in the unwinding direction in response to a predetermined rotational force on the take-up reel in the unwinding direction, the inertial locking structure including:

a first cam operatively connected to the take-up reel for rotational movement therewith and having a cam surface; and a rotational locking cam rotatable with the first cam and having an engagement surface slidable along cam surface of the first cam between an unlocked and a locked position in response to the rotational force thereon; and a locking element extending from the rotational locking cam for preventing rotation of the first cam when the locking cam is in the locked position.

15. The device of claim 14 wherein the inertial locking structure further includes an adjustment structure for adjusting the predetermined force necessary to prevent rotation of the take-up reel.

16. The device of claim 14 wherein the inertial locking structure includes a biasing structure for biasing the rotatable locking cam toward the unlocked position.

17. The device of claim 16 further comprising a housing for rotationally supporting the take-up reel, the housing including a plurality of teeth projecting therefrom.

18. The device of claim 17 wherein the locking element includes a plurality of teeth projecting from the rotatable locking cam, the teeth of the rotatable locking cam meshing with the teeth projecting from the housing when the rotatable locking cam is in the locked position.

* * * * *